US007482859B2

(12) United States Patent
Wang et al.

(10) Patent No.: US 7,482,859 B2
(45) Date of Patent: Jan. 27, 2009

(54) AUTOMATIC CURRENT TRIMMING METHOD & CIRCUITS

(75) Inventors: Zhao Wang, BeiJing (CN); Qing Yu, Beijing (CN); David Xiao Dong Yang, Beijing (CN)

(73) Assignee: Vimicro Corporation, Beijing (CN)

( * ) Notice: Subject to any disclaimer, the term of this patent is extended or adjusted under 35 U.S.C. 154(b) by 0 days.

(21) Appl. No.: 11/775,196

(22) Filed: Jul. 9, 2007

(65) Prior Publication Data

US 2008/0048766 A1 Feb. 28, 2008

(30) Foreign Application Priority Data

Jul. 17, 2006 (CN) ..... 2006 1 0098878

(51) Int. Cl.
*G05F 1/10* (2006.01)
*G05F 3/02* (2006.01)

(52) U.S. Cl. ..... 327/538; 327/539; 327/540; 327/541; 327/542; 327/543; 323/312; 323/313; 323/314; 323/315; 323/316

(58) Field of Classification Search ..... 327/538; 323/312
See application file for complete search history.

(56) References Cited

U.S. PATENT DOCUMENTS 6,304,201 B1 * 10/2001 Moreland et al. ..... 341/154
7,009,449 B2 * 3/2006 Habring et al. ..... 330/254

* cited by examiner

*Primary Examiner*—Kenneth B Wells
*Assistant Examiner*—John W Poos
(74) *Attorney, Agent, or Firm*—Joe Zheng

(57) ABSTRACT

Techniques pertaining to a circuit architecture capable of controlling a current source to a predefined precision are disclosed. According to one aspect of the present invention, an automatic trimming circuit is proposed to automatically trim a current generated from a current generator or circuit in accordance with a reference current. The automatic trimming circuit includes a comparator, an ADC and a register. The comparator that may be implemented as a subtractor finds a difference between a generated current and a reference current. The difference is then digitized to an n-bit precision. A digital representation of the difference is then kept in a register and used subsequently correct or modify the generated current to produce a precisely controlled current.

16 Claims, 5 Drawing Sheets

AUTOMATIC CURRENT TRIMMING METHOD & CIRCUITS

BACKGROUND OF THE INVENTION

1. Field of the Invention

The present invention relates to the area of integrated circuits, and more particularly to a circuit for trimming a current source.

2. Description of Related Art

Current sources may be found in various integrated circuits (IC), such as DC/DC converters. An accurate current source helps improve the electrical performance and also helps to increase the yield in fabrication with small variation. In addition, a designer often requires a highly accurate output current so that an implementation using the current could be made relatively easier. However, it is not trivial to create an accurate current source on a chip without external components because on-chip component values often change.

In the state of the art, two methods are often used to control a current source. One of them is to allocate a special pin and connect it to an external accurate resistor. An internal voltage buffer is implemented to regulate the current flowing through the resistor. In many cases, however, an allocation of this special pin is not practical in many discrete analog devices. Another method is to design an on-chip trimming circuit. The process variations may be corrected by the trimming circuit after fabrication. Some designs adopt on-wafer trimming while others choose after-package trimming. Both of them have some inherent drawbacks. The on-wafer trimming might experience a serious shift after package. Furthermore, some trimming techniques like metal-fuse trimming and poly-fuse trimming may lead to reliability Issues. The main problem of the after-package trimming is the additional cost because design complexity increases die size and needs more design effort. Therefore, a simpler circuit structure or trimming method is in demand. Further, flexibility in a trimming technique is also needed so that a resulted trimming current value may be adjusted by an end user.

SUMMARY OF THE INVENTION

This section is for the purpose of summarizing some aspects of the present invention and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present invention.

In general, the present invention pertains to a circuit architecture capable of controlling a current source to a predefined precision in accordance with a reference current. According to one aspect of the present invention, an automatic trimming circuit is proposed to automatically trim a current generated from a current generator or circuit. The automatic trimming circuit includes a comparator, an ADC and a register. The comparator that may be implemented as a subtractor finds a difference between a generated current and a reference current. The difference is then digitized to an n-bit precision. A digital representation of the difference is then kept in a register and used subsequently to correct or modify the generated current to produce a precisely controlled current.

One of the features in the present invention is that the operation of trimming a current in a circuit is performed via a connection (e.g., a connector or a pin on a chip) that is used for regular operation of the circuit. The present invention may be advantageously used in an integrated circuit (IC) so that the number of pins of the IC does not have to be increased in order to include the current trimming features as described in the present invention.

The present invention may be implemented as a circuit or a part of integrated circuit. According to one embodiment, the present invention is a circuit architecture that comprises a current generator configured to generate a current; and a trimming unit configured to automatically modify the current in accordance with a reference current, wherein the trimming unit includes an ADC to digitize a difference between the current and the reference current, a digital representation of the difference is used subsequently to produce an accurate current by modifying the current from the current generator.

The circuit architecture further comprises circuitry to drive an external component via a connector of the circuit architecture while the same connector is used to facilitate the trimming unit to modify the current from the current generator by coupling to an external resistor.

One of the features, benefits and advantages in the present invention is to provide techniques for trimming a current source to a predefined precision without requiring an addition connection.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The detailed description of the present invention is presented largely in terms of procedures, steps, logic blocks, processing, or other symbolic representations that directly or indirectly resemble the operations of devices or systems contemplated in the present invention. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the invention do not inherently indicate any particular order nor imply any limitations in the invention.

Embodiments of the present invention are discussed herein with reference to FIGS. 1-5. However, those skilled in the art will readily appreciate that the detailed description given herein with respect to these figures is for explanatory purposes only as the invention extends beyond these limited embodiments.

Figure 1:
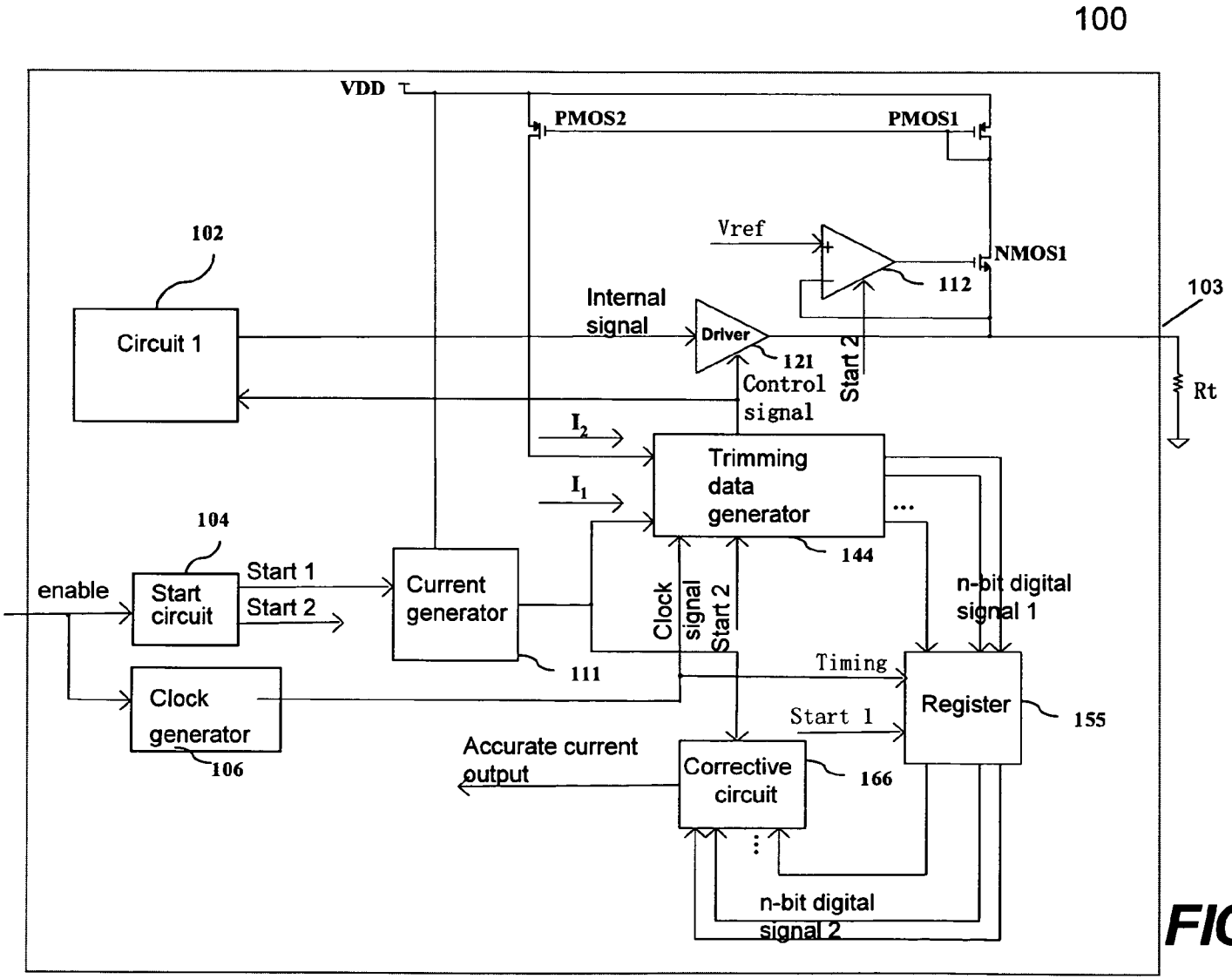
FIG. 1 shows an architecture including an automatic trimming circuit according to one embodiment of the present invention.

FIG. 1 shows architecture 100 including an automatic trimming circuit according to one embodiment of the present invention. The architecture 100 can be implemented in a discrete circuit, an integrated circuit or a part of a system. The architecture 100 includes three parts, a functional part, an automatic trimming part and a control signal part. The functional part (a.k.a., a driving circuit 102) represents all circuits in a chip except for the automatic trimming part and the control signal part. For example, to drive a power switch coupled to a connector or pin 103, an internal current from the driving circuit 102 is applied to the power switch via a driver 121. However, it should be noted that the driver 121 is controlled by a control signal that causes the driver 121 not to function or disconnected electronically from the power switch during a period in which a current is being corrected. The same pin 103 is used to facilitate a current correction by coupling to a resistor Rt (typically with very large resistance). One of the important features in the architecture 100 is that the pin 103 is shared for operation of an automatic trimming circuit and driving a load.

The automatic trimming part includes a trimming data generator 144, a register 155 and a corrective circuit 166. With a generated current, the automatic trimming part is operatively designed to correct the current in accordance with a reference current. In operation, an op-amp 112 is employed to regulate two gates NMOS1 and NMOS1 that are connected as a source follower. When the automatic trimming procedure is started, a source voltage of NMOS1 is regulated to be equal to the voltage at (+) input of the op-amp 112, noted as Vref. As a result, the current Iref flowing though NMOS1 and Rt is also regulated. The current value Iref is equal to or substantially close to Vref/R1. This current is mirrored by a current mirror circuit comprised of two transistors PMOS1 and PMOS2. The mirrored current I2 is M times Iref, where M is a magnitude dictated by the current mirror circuit.

The mirrored current I2 is coupled to a trimming data generator 144 and compared with a current I1 generated in a current generator 111. The current generator 111 may be implemented using any known circuit and synchronized under a start signal (labeled as start 1) to generate the current I1. By comparing the two currents I1 and I2, the trimming data generator 144 outputs a comparison result. In one embodiment, the comparison result, namely a difference between the two currents, is represented in N-bit digital signals to form the trimming data. Depending on a precision requirement, N is a design choice for output current accuracy. If a higher accuracy is demanded, N will be increased.

The N-bit digital signals are stored in a register 155. Typically, the trimming data, the N-bit digital signals stored in the register 155 will not be changed unless a device/chip employing the automatic trimming part is reset or restarted. The output of the register 155 is coupled to a corrective circuit 166 that also receives the current I1. The corrective circuit 166 is designed to correct the current I1 based on the output of the register 155. As a result, the corrected current I1, namely an accurate current, is thus generated.

Figure 5:
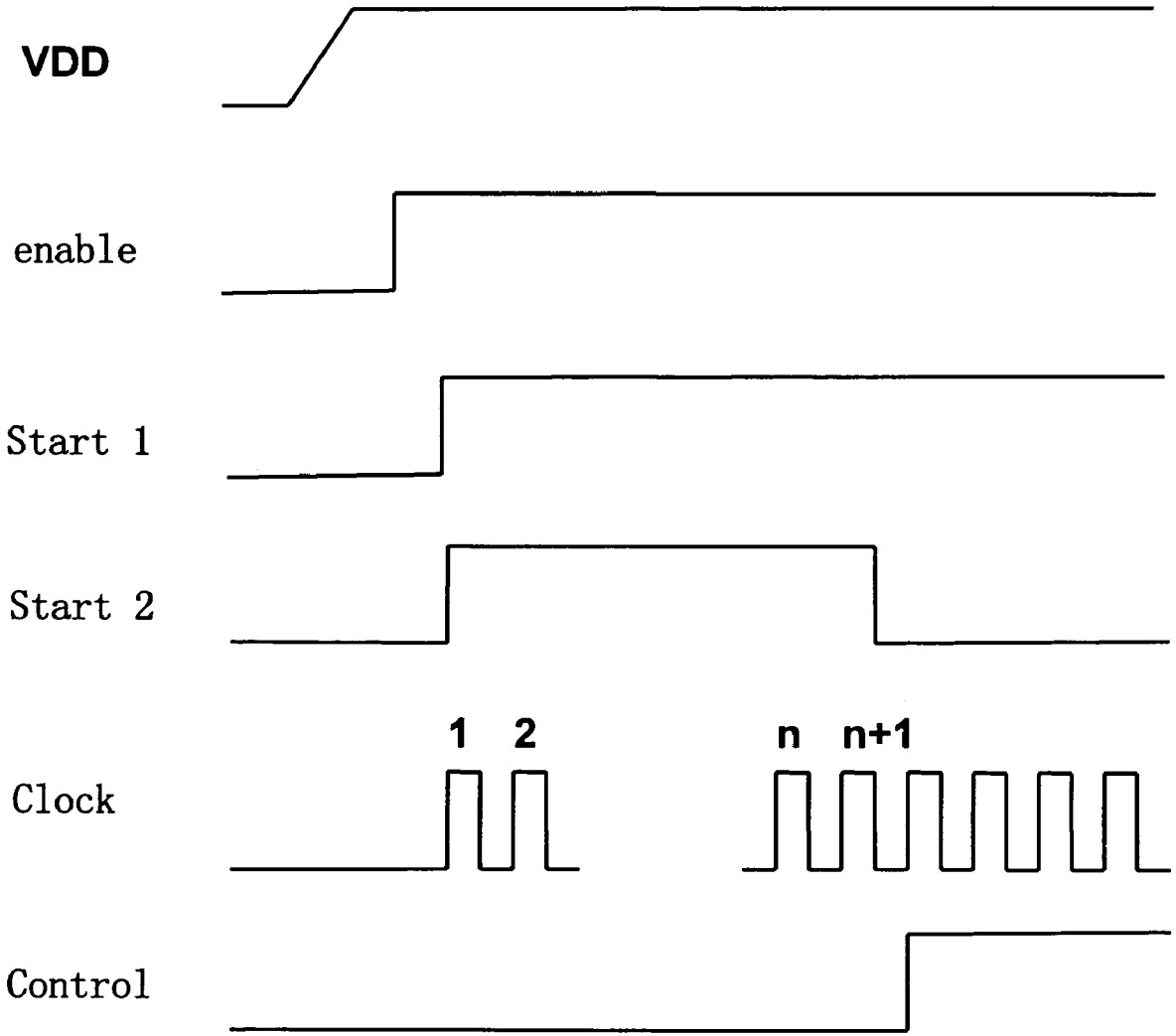
FIG. 5 shows a timing diagram of a number of control signals.

The third part of the architecture 100 is the control signal part designed to generate various control signals. FIG. 5 shows a timing diagram of a number of control signals. When a device/chip employing the automatic trimming part is started or reset, VDD is caused to apply on a circuit employing the architecture 100. As shown in FIG. 5, it takes some time for a power supply to rise from zero to a predefined voltage VDD. An enable signal starts once VDD is reached. Soon afterwards, two start signals Start 1 and Start 2 are on except that Start 2 goes off after n+1 clocks. A control signal also starts after n+1 clocks to enable the device/chip to operate as designed. As will be further described, during the period of n+1 clocks, a difference between the current generated from the current generator 111 and Iref is successfully detected, if any, and stored in the register 155.

Figure 2:
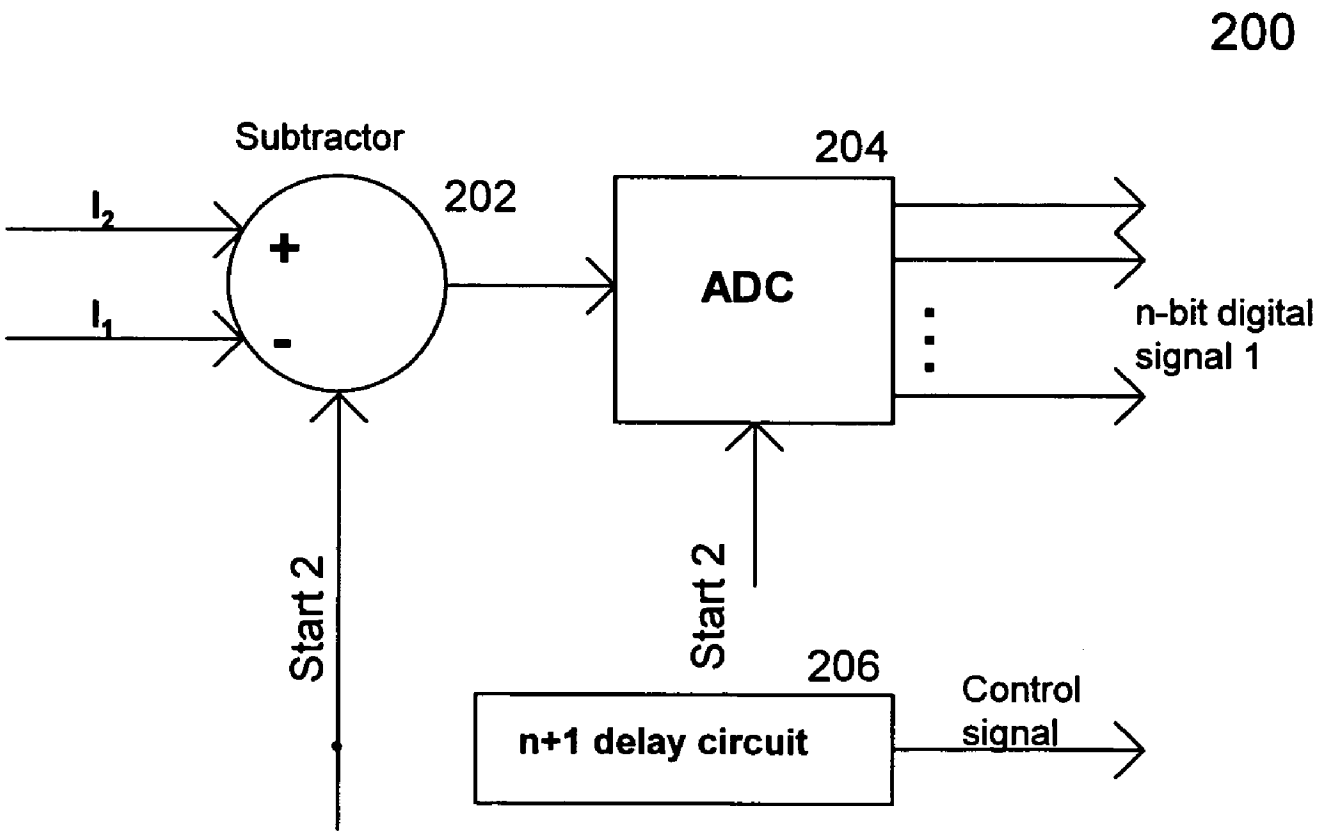
FIG. 2 shows an exemplary embodiment of a trimming data generator that may be used in FIG. 1.

FIG. 2 shows an exemplary embodiment 200 of the trimming data generator 144. A subtractor 202 is provided to measure the difference between two currents I1 and I2 in responding to a start signal Start 2. The difference is then digitized in an ADC 202. Depending on a precision requirement, the ADC 202 produces a n-bit digital signal (labeled as signal 1) that is coupled to and stored in the register 155 of FIG. 1. In addition, there is a delay circuit 206 to generate a control signal. In one embodiment, the delay circuit 206 receives a start signal (e.g., Start 2) and delays it for n+1 clocks to produce the control signal.

Figure 3:
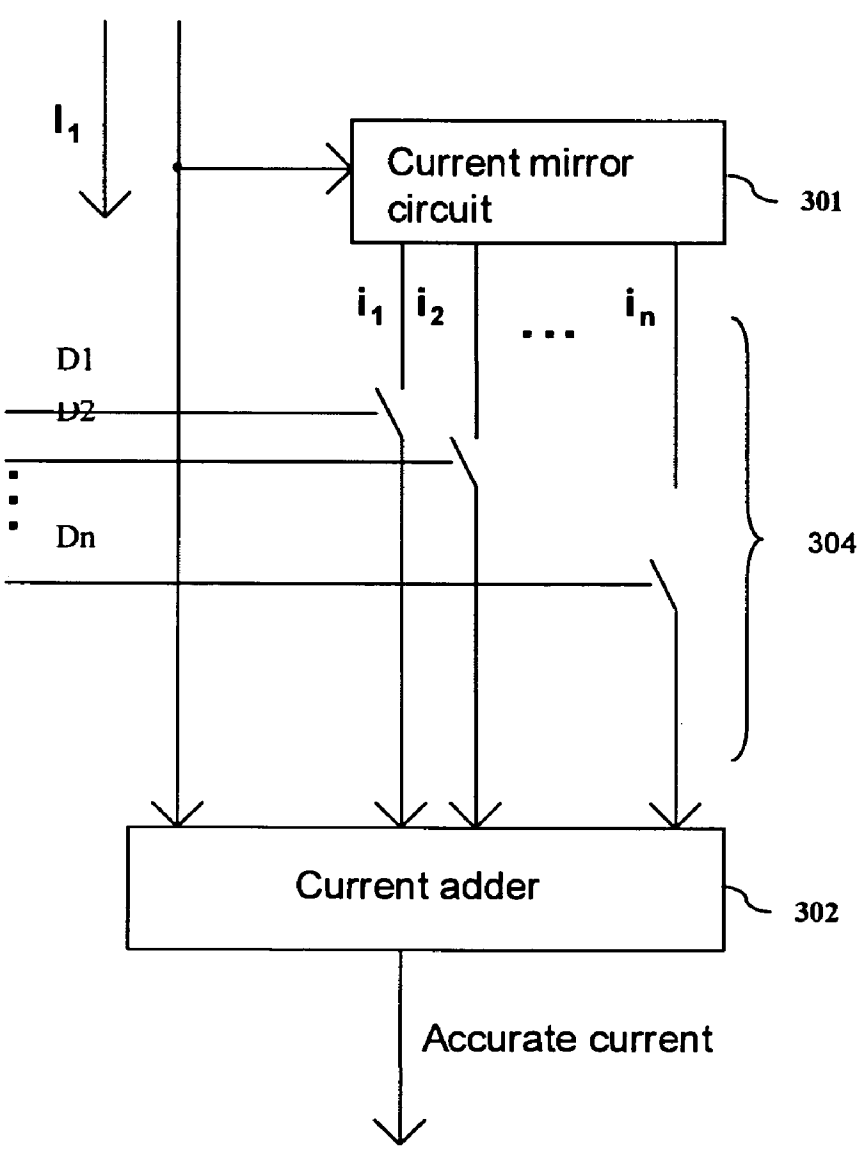
FIG. 3 shows an exemplary embodiment of a corrective circuit that may be used in FIG. 1.

FIG. 3 shows an exemplary embodiment 300 of the corrective circuit 166. The circuit 300 includes a current mirror circuit 302 and a current adder 302. The current mirror circuit 302 receives I1 from the current generator 111 and generates a series of divided currents. In one embodiment, the divided currents are in geometric series. For example, there are i1, i2, i3, . . . , in mirror currents with a ratio being 1/2, where in=2^1i(n−1)=2^(n−2)i2=2^(n−1)i1. The divided currents are respectively coupled to a current adder 302 via a plurality of switches 304. These switches 304 are controlled by the output of the register 155. Accordingly, if there are n bits in precision, there are n switches, each of the n-bits controlling a corresponding one of the n switches. Using the output of the register 155 that represents a difference between I1 and I2, the switches 304 can be controlled accordingly to modify the current I1 by adding some of the divided currents. As a result, the corrective circuit 166 outputs an accurate current.

For example, I1=1 uA while I2 is 2 uA. The difference from the substractor 202 is 1 uA. It is assumed that the quantization of the ADC 204 is 1/8 uA (3-bit). Accordingly, there are eight divided currents i1, i2, . . . i8, whose values are 1/8, 2/8, 3/8, . . . 7/8, and 8/8/. The divided currents are logically combined to produce a correction value to be used to modify the current I1 and subsequently produce an accurate current.

Figure 4:
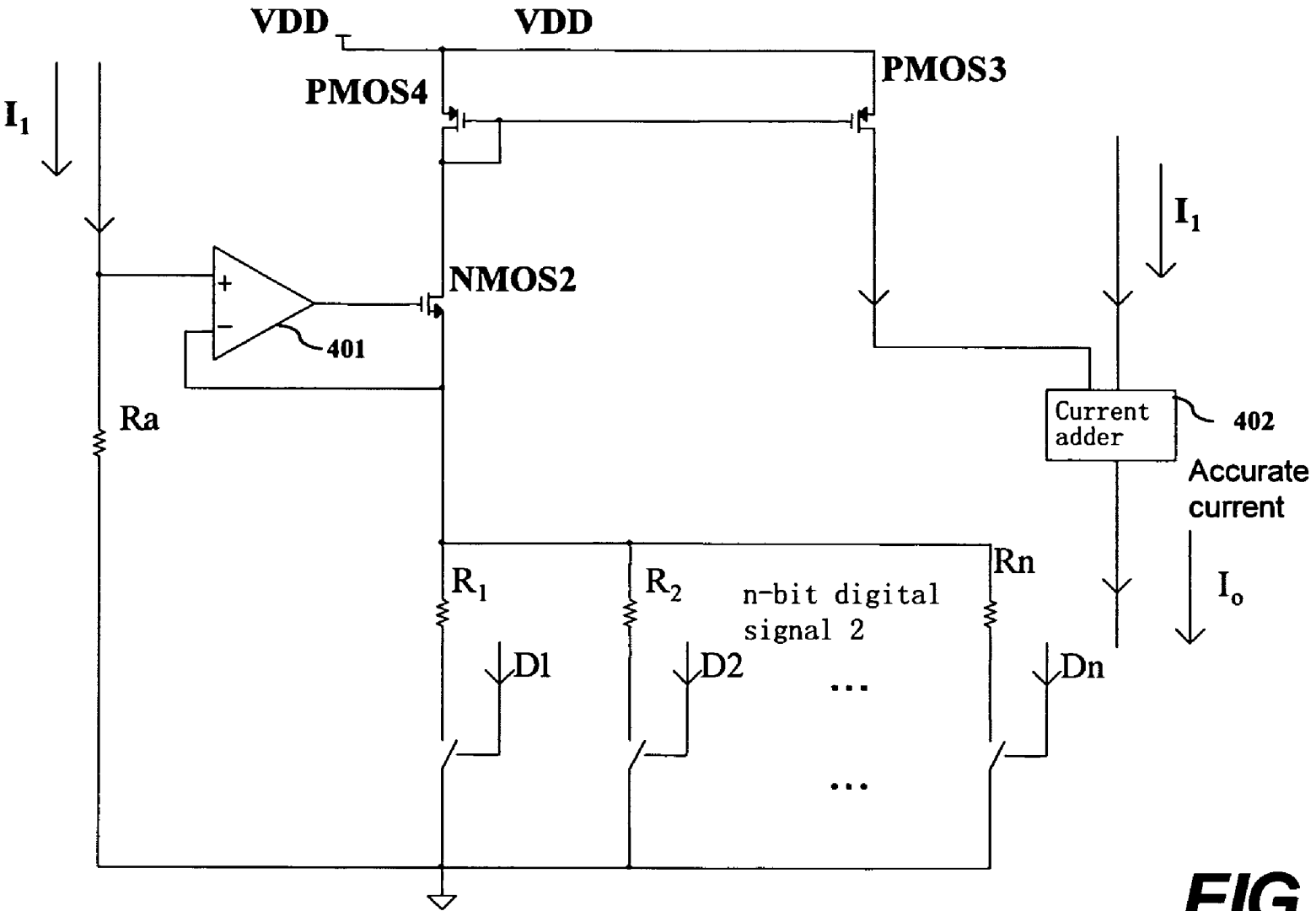
FIG. 4 shows another exemplary circuit of dividing a current to a number of divided currents.

FIG. 4 shows another exemplary circuit 400 of dividing a current to a number of divided currents. The circuit 400 includes an Op-amp 401 and a current adder 402. The (+) input of the Op-amp 401 is coupled to a resistor Ra. The (−) input of the Op-amp 401 is coupled to NMOS2 which acts as a source follower. The source follower is coupled to an array of resistors whose resistance values are decided depending on what divided currents are desired. There is a switch for each of the resistors so that, when the switch is on, a corresponding current is produced. In one embodiment, the resistance values of R1, R2, . . . Rn are in geometric series to generate corresponding divided currents in geometric series. When these divided currents are selectively added up, the accurate current is produced as follows:

$$I\text{out}=I1+1i\times Ra[(D1/R1)+(D2/R2)+\ldots+(Dn/Rn)]$$

where D1, D2, . . . Dn represent, respectively, the switches that may be 1 when turned on and 0 when turned off.

A pair of PMOS transistors PMOS3 and PMOS4 are provided to receive the collected divided currents produced from the array of resistors and coupled the accumulated current to the current adder 402. The current adder 402 receives the current I1 and the accumulated current and produces the current Iout.

It is assumed that a precision requirement is 5-bit, where n=5. Accordingly, Iout=I1+1i×Ra[(D1/R1)+(D2/R2)+(D3/R3)+(D4/R4)+(D5/R5)]. If R1=Ra, R2=2Ra, R3=4Ra, R4=8Ra, and R5=16Ra, Iout=I1+1i×[(D1/1)+(D2/2)+(D3/4)+(D4/8)+(D5/16)]. The following table may then be obtained.

| D1D2D3D4D5 | Iout |
|---|---|
| 00000 | 0 + I1 |
| 00001 | 1/16 + I1 |
| 00010 | 2/16 + I1 |
| 00011 | 3/16 + I1 |
| 00100 | 4/16 + I1 |
| . . . | . . . |
| 11111 | 15/16 + I1 |

If I1 changes within a range from 5 to 10 uA with I2 being 8 uA, the following corrected current may be obtained:

When i1=5 uA, D1D2D3D4D5 are set to be 01010, Iout=3.125+5=8.125 uA;

When i1=6 uA, D1D2D3D4D5 are set to be 00101, Iout=1.875+6=7.875 uA;

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

What is claimed is:

1. A circuit architecture comprising:

a current generator configured to generate a current;

a trimming unit configured to automatically modify the current in accordance with a reference current, wherein the trimming unit includes an ADC to digitize a difference between the current and the reference current, a digital representation of the difference is used subsequently to produce an accurate current by modifying the current from the current generator, wherein the trimming unit further comprises a trimming data generator, a register and a corrective circuit; and a circuit to drive an external component via a connector of the circuit architecture.

2. The circuit architecture as recited in claim 1, wherein the connector is also used to facilitate the trimming unit to modify the current from the current generator by coupling to an external resistor.

3. The circuit architecture as recited in claim 2, wherein the trimming data generator includes a subtractor and the ADC, the subtractor produces the difference by comparing the generated current with the reference current.

4. The circuit architecture as recited in claim 3, wherein the digital representation of the difference produced by the ADC is in n bits.

5. The circuit architecture as recited in claim 4, wherein the digital representation of the difference is kept in the register.

6. The circuit architecture as recited in claim 5, wherein the digital representation of the difference in the register is used to control means for generating divided currents from the generated current.

7. The circuit architecture as recited in claim 6, wherein each of the divided currents corresponds to one of the n bits.

8. The circuit architecture as recited in claim 7, wherein the divided currents are selectively to be added to the generated current in accordance with the digital representation of the difference in the register.

9. The circuit architecture as recited in claim 1, wherein the divided currents are selectively to be added to the generated current via a plurality of n switches.

10. The circuit architecture as recited in claim 9, wherein each of the n switches is controlled by one of the n bits.

11. The circuit architecture as recited in claim 9, wherein a "0" in the digital representation of the difference causes one of the switches to be closed so that a corresponding one of the divided currents is generated and added to the generated current.

12. The circuit architecture as recited in claim 9, wherein a "1" in the digital representation of the difference causes one of the switches to be closed so that a corresponding one of the divided currents is generated and added to the generated current.

13. The circuit architecture as recited in claim 1, wherein the current generator operates to generate the current when a first start signal comes after a power supply has steadily reached a predefined voltage.

14. The circuit architecture as recited in claim 13, wherein the divided currents are selectively to be added to the generated current via a plurality of n switches, and a second start signal starts at the same time as the first start signal but ends right after n+1 clocks.

15. The circuit architecture as recited in claim 14, wherein a control signal starts right after the trimming unit finishes to get the digital representation of the difference and enables the circuitry to drive the external component via the connector.

16. The circuit architecture as recited in claim 1, wherein the circuit architecture is implemented in a discrete or an integrated circuit.

* * * * *